United States Patent [19]

Körner et al.

[11] 4,129,404

[45] Dec. 12, 1978

[54] ARRANGEMENT OF AIR COMPRESSOR AT A RECIPROCATING PISTON INTERNAL COMBUSTION ENGINE

[75] Inventors: Wolf-Dietrich Körner, Hochberg, Uber Ludwigsburg; Otto Hartmann, Stuttgart, both of Germany

[73] Assignee: Daimler-Benz Aktiengesellschaft, Germany

[21] Appl. No.: 107,738

[22] Filed: Jan. 19, 1971

[30] Foreign Application Priority Data

Jan. 21, 1970 [DE] Fed. Rep. of Germany ..... 2002470

[51] Int. Cl.[2] ..... F04B 35/00; F04B 17/00

[52] U.S. Cl. ..... 417/364; 123/195 A

[58] Field of Search ..... 417/364, 236, 238, 313; 123/198 C, 195 A

[56] References Cited

U.S. PATENT DOCUMENTS

| | | | |
|---|---|---|---|
| 1,308,465 | 7/1919 | White | 417/364 |
| 1,450,684 | 4/1923 | Kirsch | 123/195 A |
| 1,758,687 | 5/1930 | Chorlton | 417/364 X |
| 1,920,371 | 8/1933 | Franke | 417/61 |
| 1,967,001 | 7/1934 | Vorech et al. | 417/364 X |
| 2,303,093 | 11/1942 | Schreck | 123/195 A |
| 2,452,232 | 10/1948 | Fischer | 123/195 A |
| 2,784,710 | 3/1957 | Kremser | 123/195 A |
| 3,211,365 | 10/1965 | Phelps | 417/319 |
| 3,384,063 | 5/1968 | Moulton et al. | 417/364 |
| 3,597,115 | 8/1971 | Jass et al. | 417/364 X |

FOREIGN PATENT DOCUMENTS

| | | | |
|---|---|---|---|
| 270153 | 5/1927 | United Kingdom | 123/195 A |
| 471319 | 9/1937 | United Kingdom | 123/195 A |

*Primary Examiner*—William L. Freeh
*Attorney, Agent, or Firm*—Craig & Antonelli

[57] ABSTRACT

An arrangement of an air compressor which includes at least one piston connected with a crankshaft, at a piston internal combustion engine, particularly at a truck engine, in which the crankshaft of the air compressor is supported in the control housing adjoining the output side of the engine whereby the air compressor cylinder or cylinders are mounted on the control housing.

9 Claims, 3 Drawing Figures

INVENTOR
WOLF-DIETRICH KÖRNER

BY Craig, Antonelli, Stewart & Hill
ATTORNEYS

INVENTOR
WOLF-DIETRICH KÖRNER

BY Craig, Antonelli, Stewart & Hill
ATTORNEYS

ARRANGEMENT OF AIR COMPRESSOR AT A RECIPROCATING PISTON INTERNAL COMBUSTION ENGINE

The present invention relates to the arrangement of the air compressor, which includes at least one piston connected with a crankshaft, at a piston internal combustion engine, especially at a truck engine.

Customarily, the air compressors are arranged within the front area of the engine separate from the latter and are driven from the engine crankshaft by way of V-belts. This arrangement entails the disadvantage that it is structurally quite expensive and necessitates a considerable space requirement.

The present invention is concerned with the task to enable by a special arrangement of the air compressor a structural simplification and better space utilization. The present invention essentially consists in that the crankshaft of the air compressor is journalled in the control housing adjoining the output side of the engine, on which are secured the air compressor cylinder or cylinders. A separate crankcase for the air compressor is economized thereby whereas additionally the air compressor is accommodated within a space not utilized heretofore.

In order to be able to dispense with the V-belt drive, it is particularly advantageous if the drive of the crankshaft of the air compressor takes place from the engine crankshaft by way of gears. These gears are lubricated by the oil mist within the engine-shaft crankcase. It is thereby particularly advantageous if the crankshaft of the air compressor is connected with a gear which meshes with the camshaft gear. With this arrangement, only one additional gear is necessary for the drive of the crankshaft of the air compressor.

A structurally advantageous embodiment of the present invention is obtained if one end of the crankshaft of the air compressor and the gear connected with the same are supported and centered in a common roller bearing. The assembly is also greatly simplified thereby. It is also advantageous if the other end of the crankshaft of the air compressor is arranged in a sliding or friction bearing fed with pressure oil, from which a pressure oil channel leads through the crankshaft to the bearing or bearings of the connecting rods of the air compressor. A completely satisfactory lubrication is achieved thereby in a simple manner.

According to a further feature and development of the present invention, a further aggregate, especially a steering servo pump is adapted to be connected to the sleeve bearing end of the crankshaft of the air compressor. In order to obtain the largest feasible variation possibilities, i.e., the greatest possible versatility, the control housing may include several connecting places for the threaded connection of one or several air compressor cylinders at different angles. It is thereby particularly appropriate for the assembly if at least one of the connecting places for the air compressor is so dimensioned that the crankshaft of the air compressor can be passed therethrough for purposes of assembly and disassembly.

Accordingly, it is an object of the present invention to provide an arrangement of an air compressor in a piston internal combustion engine which avoids by simple means the aforementioned shortcomings and drawbacks encountered in the prior art.

Another object of the present invention resides in an air compressor arrangement of an internal combustion engine, especially for trucks, which enables a structural simplification and improved space utilization.

A further object of the present invention resides in an air compressor arrangement for a piston internal combustion engine which minimizes the parts necessary for the mounting of the air compressor while more effectively utilizing the space available within the engine compartment.

A still further object of the present invention resides in an air compressor arrangement of the type described above, which not only dispenses with V-belt drives, assures a completely satisfactory lubrication of all the parts of the air compressor and permits an appropriate utilization of available space for the mounting of additional aggregates, but also permits a ready disassembly of the air compressor without the disassembly of any parts of the engine, properly speaking.

These and further objects, features and advantages of the present invention will become more obvious from the following description when taken in connection with the accompanying drawing, which shows, for purposes of illustration only, one embodiment in accordance with the present invention, and wherein.

Figure 1:
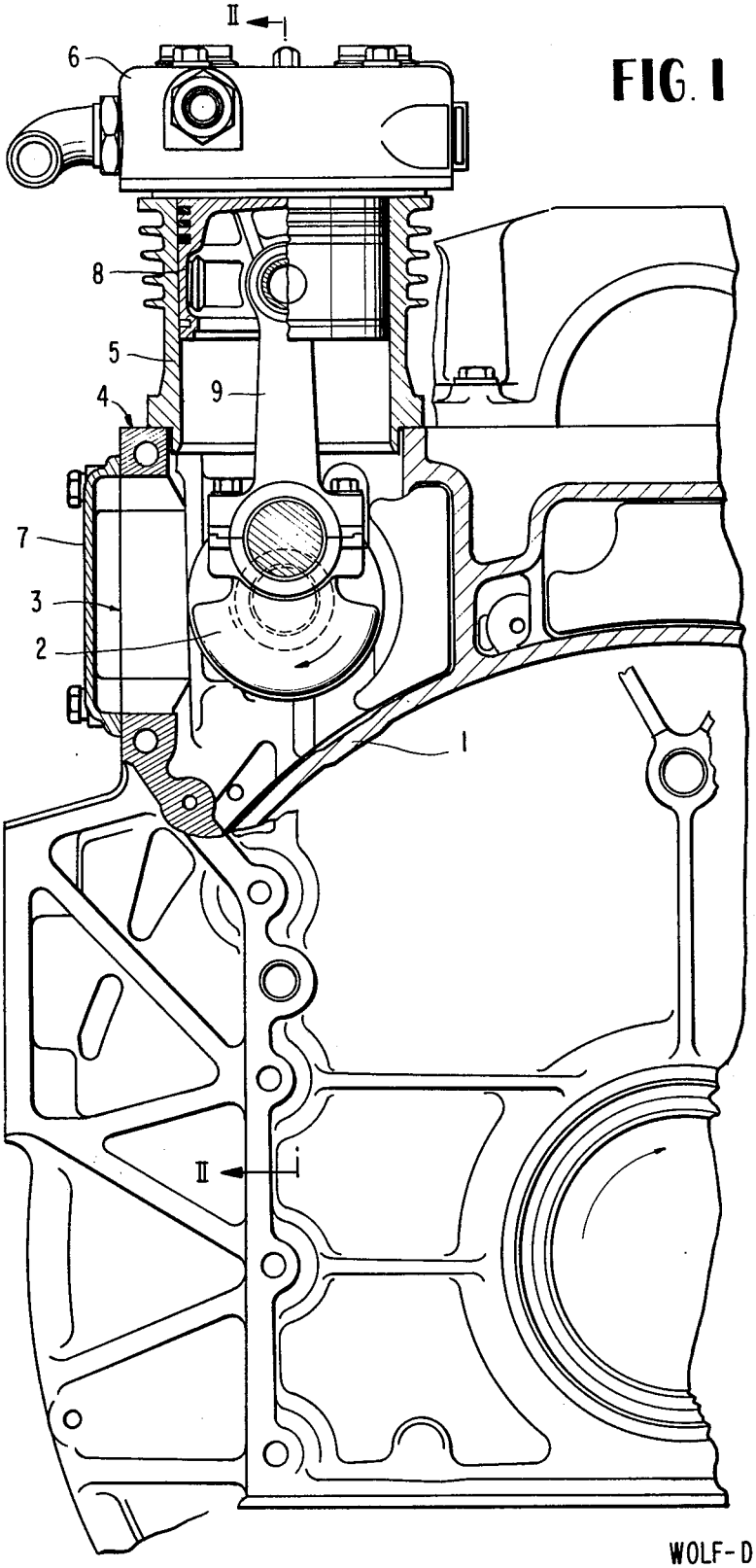
FIG. 1 is a rear view, partially in cross section, of a control housing of an internal combustion engine with the arrangement of the air compressor according to the present invention.

Referring now to the drawing wherein like reference numerals are used throughout the two views to designate like parts, the control housing illustrated in FIG. 1 and shown partially in cross section is arranged on the output side of a piston internal combustion engine (not shown) of a truck and serves for the accommodation of the usual control aggregates of the engine. As is customary, the control wheels for the camshafts and also the drive wheels or gears for the injection pump or the like are arranged in the control housing 1. Additionally, the control housing 1 serves for the accommodation of a flywheel which is accommodated within the control housing 1 on the side opposite of the engine. The clutch (not shown) adjoins the control housing 1 and the transmission (not shown) adjoins the clutch in the usual manner.

Figure 1A:
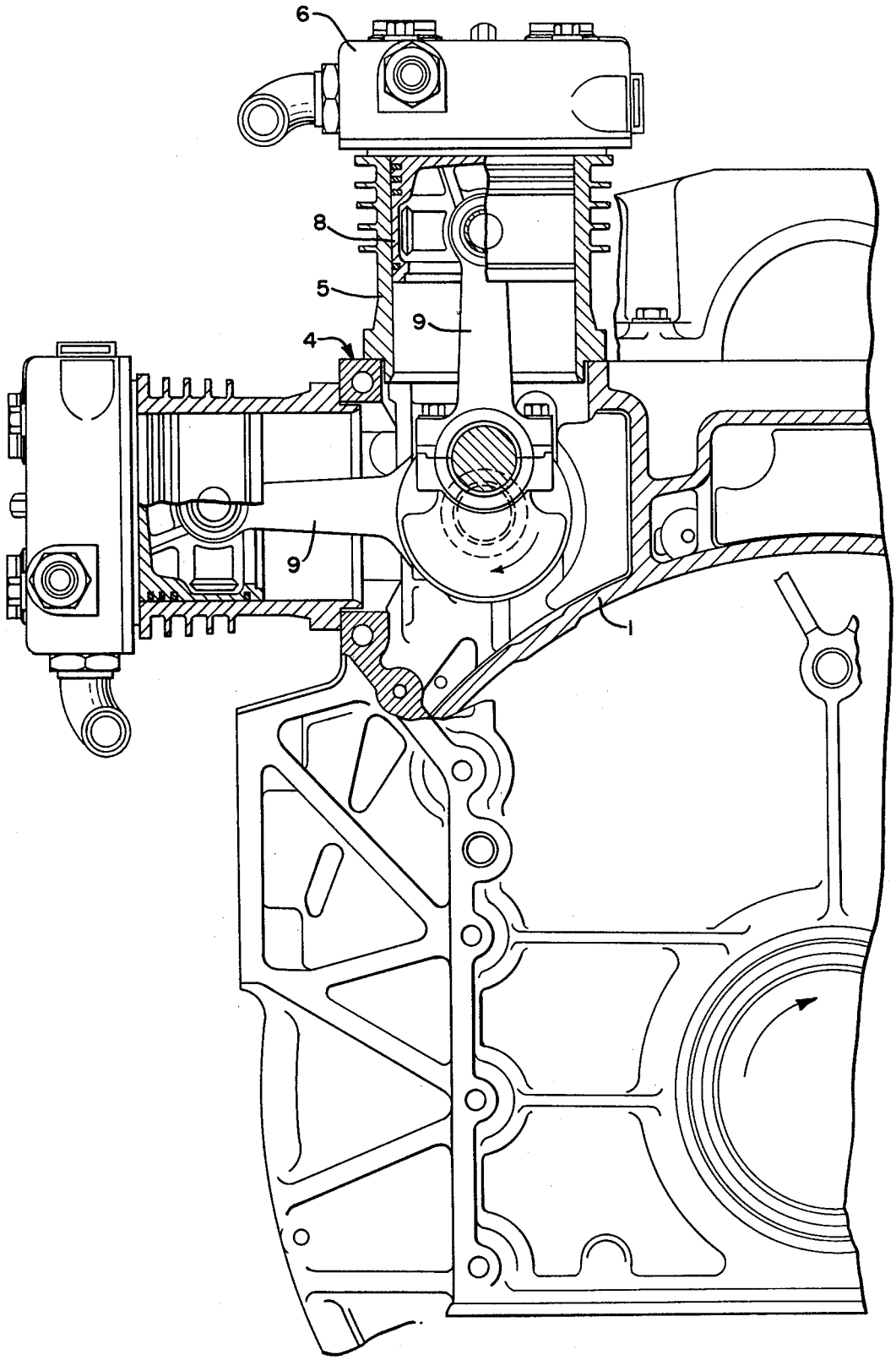
FIG. 1A is a view similar to FIG. 1 only showing two compressor cylinders mounted on the control housing.

The control housing 1 is extended outwardly and is constructed at the same time as crank case for the crankshaft 2 of the air compressor. The control housing 1 is provided with two connecting places generally designated by reference numerals 3 and 4 which permit a threaded connection and mounting of the air compressor cylinder 5 so that the air compressor cylinder 5 together with its cylinder cover 6 containing its control installations can be connected vertically as also horizontally. It is also possible to arrange, in lieu of the cover 7 of the second connectiong place 3, a second air compressor cylinder whose piston would be driven like the illustrated piston 8 of the air compressor cylinder 5 from the same crankshaft 2 by way of a second connecting rod 9. The crankshaft 2 provided with a single throw, would then have to be equipped with two bearing surfaces for the connecting rods 9. FIG. 1A schematically illustrates the arrangement with a second air compressor cylinder and piston connected to the control housing.

Figure 2:
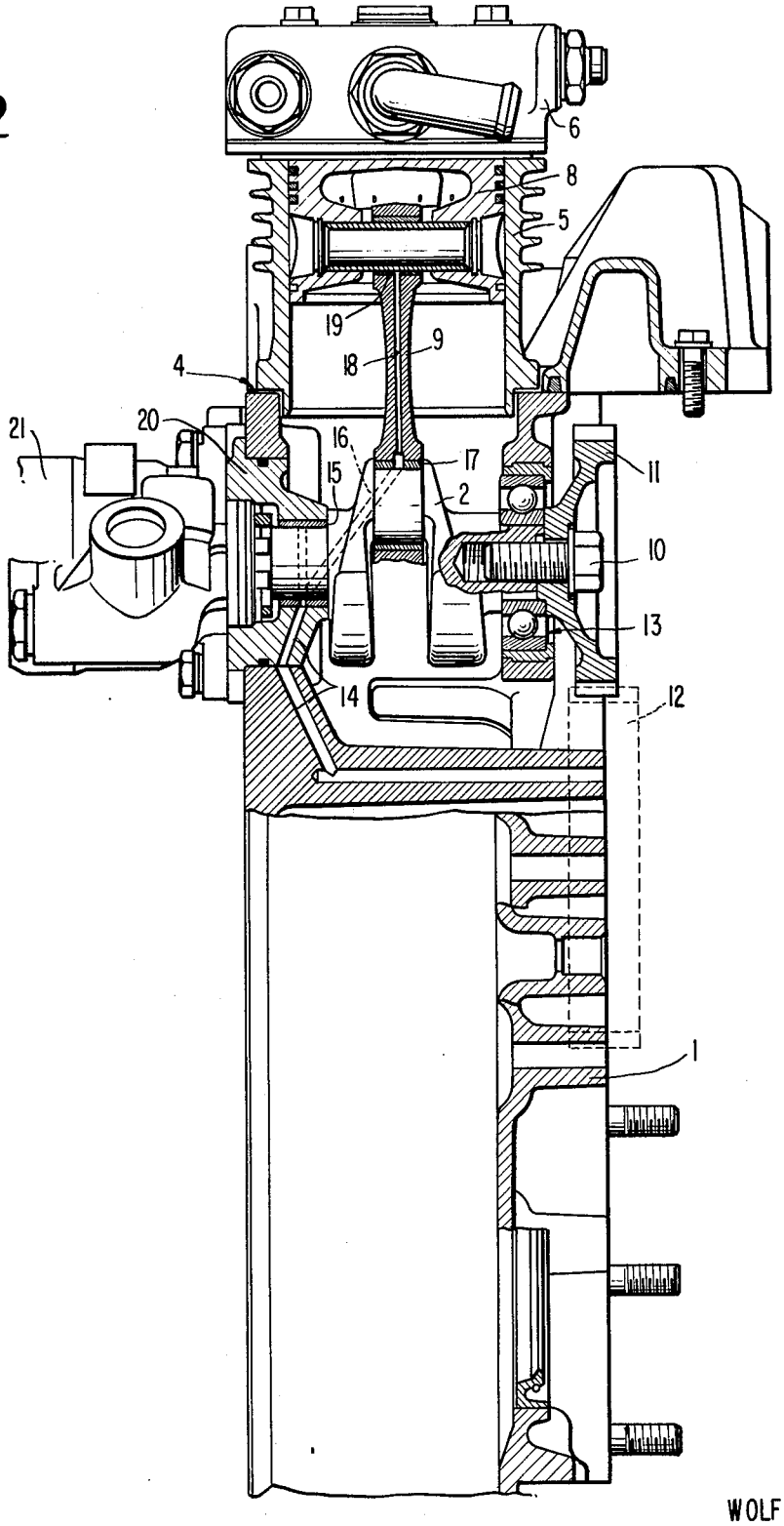
FIG. 2 is a partial cross-sectional view, taken along line II-II of FIG. 1.

It can be seen from FIG. 2 how the drive and the bearing support of the crankshaft 2 of the air compressor is realized according to this invention. One end of the crankshaft 2 which faces the output side of the engine, is connected by way of a bolt 10 with a gear wheel 11 which engages with the camshaft gear 12 indicated in dash line and driven by the crankshaft of the engine. This end of the crankshaft 2 and the gear 11 are supported in a common roller bearing generally designated by reference numeral 13. Provision may thereby be made, as shown by the lower half of the bearing 13 that the crankshaft 2 as also the gear 11 bolted thereto are both centered in the roller bearing 13. However, it is also possible, as shown by the upper half of the bearing 13 illustrated in FIG. 2 of the drawing, to support the gear 11 at the inner race of the bearing 13 and to center the gear 11 within the end of the crankshaft 2. The other end of the crankshaft 2 is supported in a friction or sliding bearing 15 fed with pressure oil by way of a channel 14. A pressure oil channel 16 arranged on the inside of the crankshaft 2 leads from this friction bearing 15 to the connecting rod bearing 17 so that also the latter is lubricated with pressure oil. A pressure oil channel 18 is also provided in the connecting rod 9 which conducts the pressure oil to the piston bearing 19. The connecting place 4 is thereby so dimensioned that it is possible after the removal of the bearing ring 20 provided with the friction bearing 15, to disassemble the crankshaft 2 of the air compressor upwardly out of the connecting place 4 so that an engine disassembly is not necessary.

As also shown in FIG. 2, it is possible to connect to the end of the crankshaft 2 supported in the friction bearing 15 a further aggregate, in the illustrated embodiment, a steering servo-pump 21.

It is also possible without difficulty to arrange the connecting place 3 or 4 for the air compressor cylinder with such an inclination that the most favorable space conditions are created in every case. The crankshaft 2 of the air compressor, however, is always disposed parallel to the crankshaft of the engine.

While I have shown and described only one embodiment in accordance with the present invention, it is understood that the same is not limited thereto but is susceptible of numerous changes and modifications as known to those skilled in the art, and I therefore do not wish to be limited to the details shown and described herein, but intend to cover all such changes and modifications as are encompassed by the scope of the appended claims.

What is claimed is:

1. An air compressor arrangement for use with a piston-type internal combustion engine of the type having an engine crankshaft, an engine output side, and a clutch means arranged adjacent the engine output side; said arrangement comprising: control housing means arranged at the output side of the engine between the clutch and the engine, a compressor crankshaft bearing means rotatably supporting said compressor crankshaft in the control housing means, compressor cylinder means including at least one compressor cylinder, compressor piston means including at least one compressor piston drivingly connected to said compressor crankshaft and arranged for reciprocating movement within the respective at least one compressor cylinder in response to rotation of said compressor crankshaft, compressor cylinder connecting means for detachably connecting said compressor cylinder means to said control housing means, and compressor crankshaft driving means operatively connected to the engine crankshaft for rotatably driving said compressor crankshaft, wherein said control housing means is an integral housing structure which accommodates engine auxiliary units such as control wheels for camshafts and the like and an engine flywheel as well as the compressor crankshaft, wherein said compressor crankshaft driving means includes a compressor gear directly and drivingly engaging a camshaft gear of the engine, wherein said compressor gear is attached to a first end of said compressor crankshaft for rotation about the rotational axis of the compressor crankshaft, wherein said bearing means includes a common roller bearing means which supports and centers both said first end and said compressor gear, and wherein said bearing means further includes an anti-friction bearing in supporting engagement with the second end of said compressor crankshaft, wherein means are provided for feeding pressure oil to said anti-friction bearing, wherein connecting rod means are provided for interconnecting said compressor piston means with said compressor crankshaft and wherein oil channels are provided for communicating the pressure oil from the anti-friction bearing to connecting rod bearing means on said connecting rod means.

2. An arrangement according to claim 1, wherein said compressor cylinder means includes a plurality of separate compressor cylinders, wherein said compressor cylinder connecting means include means for separately detachably connecting each of the compressor cylinders to the control housing means, wherein said compressor cylinders extend radially outwardly from the rotational axis of the compressor crankshaft at different angles with respect to one another, and wherein said compressor cylinder means consists of two cylinders arranged at right angles to one another with respect to the rotational axis of the compressor crankshaft.

3. An arrangement according to claim 1, wherein said control housing means includes at least one aperture having a flange around the edge thereof for engaging a corresponding flange on a respective at least one compressor cylinder when said respective at least one compressor cylinder is connected to said control housing means, said at least one aperture being dimensioned to permit the withdrawal of the compressor crankshaft therethrough when said respective at least one compressor cylinder is disconnected from said control housing means.

4. An arrangement according to claim 1, wherein said compressor gear is disposed in said control housing means.

5. An arrangement according to claim 1, wherein said control housing means is a unitary one-piece housing structure.

6. An arrangement according to claim 1, further comprising an auxiliary unit drivingly conncted to one end of said compressor crankshaft.

7. An arrangement according to claim 6, wherein said auxiliary unit is a steering servo-pump.

8. An arrangement according to claim 3, wherein said compressor gear is disposed in said control housing means.

9. An arrangement according to claim 8, wherein said control housing means is a unitary one-piece housing structure.

* * * * *